US011124396B2

(12) United States Patent
Hausladen

(10) Patent No.: US 11,124,396 B2
(45) Date of Patent: Sep. 21, 2021

(54) FREE FALL WINCH

(71) Applicant: Liebherr-Components Biberach GmbH, Biberach an der Riss (DE)

(72) Inventor: Norbert Hausladen, Biberach (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 72 days.

(21) Appl. No.: 16/808,193

(22) Filed: Mar. 3, 2020

(65) Prior Publication Data

US 2020/0277170 A1 Sep. 3, 2020

Related U.S. Application Data

(63) Continuation of application No. PCT/EP2018/073212, filed on Aug. 29, 2018.

(30) Foreign Application Priority Data

Sep. 5, 2017 (DE) ..... 20 2017 105 348.2

(51) Int. Cl.
*B66D 1/54* (2006.01)
*B66D 1/22* (2006.01)

(52) U.S. Cl.
CPC ..... *B66D 1/54* (2013.01); *B66D 1/22* (2013.01); *B66D 2700/07* (2013.01)

(58) Field of Classification Search
CPC ..... B66D 1/22; B66D 1/54; B66D 2700/07
See application file for complete search history.

(56) References Cited

U.S. PATENT DOCUMENTS 1,958,037 A * 5/1934 Engler ..... B66C 3/125 254/290
3,218,034 A * 11/1965 Marinus ..... B63B 23/40 254/290
4,132,387 A * 1/1979 Somerville ..... B66D 1/52 254/340
4,358,088 A * 11/1982 House ..... B66D 1/14 192/12 B
4,426,064 A * 1/1984 Healy ..... B66D 1/14 254/342
4,625,946 A * 12/1986 Clark, Jr. ..... B66D 5/24 254/274

(Continued)

FOREIGN PATENT DOCUMENTS

CN 1128730 8/1996
CN 102328886 1/2012

(Continued)

*Primary Examiner* — Michael E Gallion
(74) *Attorney, Agent, or Firm* — Levine Bagade Han LLP

(57) ABSTRACT

The present invention relates to a free-fall winch comprising a drum which can be rotatorily driven by a winch drive via a transmission and can be retained by a holding brake, wherein in addition to the holding brake a free-fall brake is provided for slowing down the drum in free-fall operation. According to the invention, the free-fall brake is arranged between winch drive and holding brake on the one hand and drum on the other hand such that when the free-fall brake is open, the drum is decoupled from the winch drive and from the holding brake and can be rotated at idle with respect to the winch drive and the holding brake.

12 Claims, 1 Drawing Sheet

(56) References Cited

U.S. PATENT DOCUMENTS

| | | | | | |
|---|---|---|---|---|---|
| RE33,898 | E * | 4/1992 | Santos | B66D 1/7415 | 114/210 |
| 7,270,312 | B1 * | 9/2007 | Phipps | B66D 1/22 | 254/278 |
| 7,461,832 | B2 * | 12/2008 | Zhang | B66D 1/14 | 212/274 |
| 10,087,056 | B2 * | 10/2018 | Hartmann | B66D 1/14 | |
| 10,106,380 | B2 * | 10/2018 | Hausladen | B66D 1/22 | |
| 10,112,811 | B2 * | 10/2018 | Lautwein | B66D 1/12 | |
| 10,208,817 | B2 * | 2/2019 | Netecke | B66D 5/14 | |
| 10,246,311 | B2 * | 4/2019 | Bulling | B66D 1/22 | |
| 10,947,094 | B2 * | 3/2021 | Maghsoodi | B66D 3/22 | |
| 2015/0284221 | A1 * | 10/2015 | Hall | B66D 1/485 | 254/342 |
| 2016/0159626 | A1 * | 6/2016 | Hartmann | B66D 1/22 | 254/344 |
| 2017/0362067 | A1 * | 12/2017 | Hiekata | B66D 1/16 | |

FOREIGN PATENT DOCUMENTS

| | | |
|---|---|---|
| CN | 103183293 | 7/2013 |
| DE | 3223632 | 10/1988 |
| DE | 4446443 | 6/1996 |
| DE | 20006712 | 12/2000 |
| EP | 0720962 | 7/1996 |
| EP | 0538662 | 5/1997 |
| EP | 3028983 | 6/2016 |
| JP | 10-310376 | 11/1998 |
| WO | WO 2019/048303 | 3/2019 |

* cited by examiner

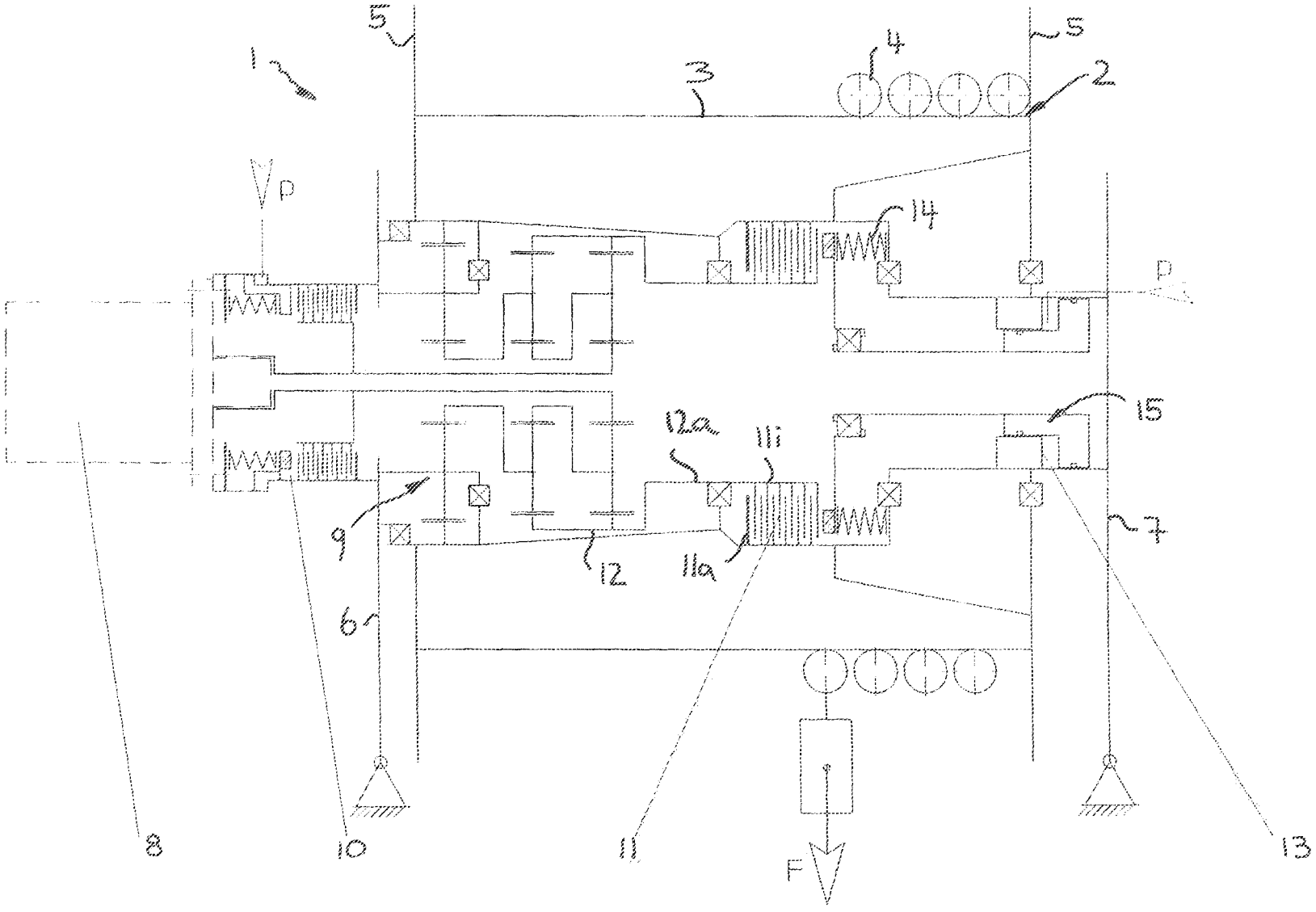
1
2
3
4
5
5
6
7
8
9
10
11
11a
11i
12
12a
13
14
15
P
P
F

FREE FALL WINCH

CROSS-REFERENCE TO RELATED APPLICATIONS

This application is a continuation of International Patent Application Number PCT/EP2018/073212 filed Aug. 29, 2018, which claims priority to German Patent Application Number 20 2017 105 348.2 filed Sep. 5, 2017, the contents of which are incorporated herein by reference in their entireties.

BACKGROUND

The present invention relates to a free-fall winch comprising a drum which can be rotatorily driven by a winch drive via a transmission and can be retained by a holding brake, wherein in addition to the holding brake a free-fall brake is provided for slowing down the drum in free-fall operation.

Free-fall winches are used in various applications in which the cable wound up on the drum of the winch or another pulling or lifting means such as for example a belt is to be unwound or lowered at high speeds over long distances, wherein the drum is rotating at idle more or less without any resistance or possibly also rotates under slight braking by the resistances of the transmission. Such unwinding sometimes is referred to as "free fall". At least at the end of the free fall it is necessary to relatively quickly slow down the cable drum in order to avoid a further uncontrolled unwinding of the cable and hence a slack cable on the winch drum and an untidy, confused cable image.

Such free-fall winches can be used for example in cable excavators when a compactor mass is dropped onto the ground in free fall for soil compaction. For this purpose, for example, individual planetary stages are decoupled in planetary transmissions used on drums so that the compactor load reaches the ground with the highest possible drop energy. Shortly before hitting the ground, however, the free-fall brake must be slowed down so as not to produce a slack cable on the winch drum.

When working with a dragline, the same likewise is thrown into a quarry pond by rotating the uppercarriage of the cable excavator—similar to casting a fishing hook by means of a fishing rod—, in order to extract gravel, for example. When the dragline hits the water surface, the drum previously activated must be slowed down in order to avoid a slack cable.

In the case of diaphragm wall grabs, by means of which very deep foundations are dug, the lowering of the grab is effected at a high, controlled falling speed, wherein here during lowering already the same must be controlled by slowing down the free-fall brake to control the falling speed.

The various applications have in common that high braking energies are to be absorbed in a very short time, wherein the heat produced here on the free-fall brake is dissipated via an oil or fluid cooling process during the hoisting operation, which regularly takes very much longer than lowering. Depending on the configuration of the free-fall brake, however, it is not quite easy to dissipate the heat quantity into the cooling fluid, in particular when the cooling fluid is not able to sufficiently wash around the free-fall brake.

Such free-fall winches furthermore involve the problem that the braking torque of the free-fall brake frequently is introduced into the counter-shield. In particular in free-fall winches in which the winch drive and the holding brake are arranged on the one winch side and the free-fall brake is positioned on the opposite drum side, the stationary part of the free-fall brake engages the bearing counter-shield so that the braking torque must be removed via the bearing counter-shield and the bearing counter-shield must be configured correspondingly massive. In addition, during the assembly of the winch the bearing counter-shield cannot be rotated into the correct position without opening the free-fall brake.

A free-fall winch as mentioned above for example is disclosed in the document EP 0 538 662 B1 in which the winch drive drives the drum via a two-stage planetary transmission which is accommodated in the interior of the drum. A sun gear of one of the planetary stages can be driven by the winch drive and on the other hand be blocked by a holding brake. A planet carrier of one of the planetary stages is guided out of the opposite end of the drum via a shaft so as to be braked there by a free-fall brake which is supported on the bearing counter-shield.

Furthermore, there are also known free-fall winches in which only one brake is employed and which at the same time utilize the holding brake as a free-fall brake. DE 3 223 632 C2 for example shows a free-fall brake whose drum is driven by a hydraulic motor via a two-stage planetary transmission, wherein the ring gear common to both planetary stages is connected to a brake shield to which the drum brake acting directly on the flanged wheel of the cable drum is attached. When the brake is closed, the torque is transmitted to the cable drum via the brake and hence the connection between motor and cable drum is achieved, whereas when the brake is open, the planetary transmission is decoupled from the cable drum. The described cooling problem, however, still exists with this brake arrangement. Moreover, for retaining the cable drum under load, for example when retaining a large lifted load, high braking forces must be applied, which must be transmitted to the drum casing via the flanged wheel on which the brake acts.

Proceeding therefrom, it is the object underlying the present invention to create an improved free-fall winch as mentioned above, which avoids the disadvantages of the prior art and develops the latter in an advantageous way. In particular, an efficient cooling of the free-fall brake will be achieved, and an easy assembly of the winch and its bearing shields will become possible even when the free-fall brake is not released.

BRIEF SUMMARY

According to the invention, said object is achieved by a free-fall winch according to claim 1. Preferred aspects of the invention are subject-matter of the dependent claims.

It hence is proposed to arrange the free-fall brake in such a way that the free-fall brake can rotate as well during operation of the winch and/or the bearing counter-shield cannot be rotated even when the free-fall brake is applied. For this purpose, the free-fall brake no longer is rotatorily firmly supported on the bearing counter-shield as was common practice so far, but is arranged in the interior of the drum between drum and winch brake as well as holding brake. According to the invention, the free-fall brake is arranged between winch drive and holding brake on the one hand and drum on the other hand such that when the free-fall brake is open, the drum is decoupled from the winch drive and from the holding brake and can rotate at idle with respect to the winch drive and the holding brake.

In particular, the free-fall brake is arranged such that always at least a part of the free-fall brake rotates along with the drum and/or with the winch drive. In contrast to free-fall brakes stationarily arranged on the bearing counter-shield, a very much better cooling can be achieved due to the continuous operation of the free-fall brake, as the cooling fluid washing around the free-fall brake is steadily circulated or at least a forced convection is achieved when no fluid washes around the free-fall brake. At the same time, by rotatorily decoupling the free-fall brake from the bearing counter-shield it is avoided that the braking torque of the free-fall brake must be dissipated via the bearing counter-shield. Correspondingly, the bearing counter-shield can be designed only for its bearing function and be configured less massive. At the same time, the bearing counter-shield can also be rotated when the free-fall brake is closed, which considerably simplifies the assembly of the winch.

In a development of the invention, one half of the free-fall brake can be non-rotatably connected to the cable drum and the other half of the free-fall brake can be non-rotatably connected to a transmission element of the transmission so that both when the free-fall brake is open and when the free-fall brake is closed at least part of the free-fall brake always is configured to rotate along with the drum. The non-rotatable connection of the one free-fall brake half to the cable drum can be effected by direct attachment to the cable drum or by indirect attachment via an intermediate part non-rotatably connected to the cable drum.

In particular, said free-fall brake is accommodated in the interior of the drum casing of the drum and is attached to the drum casing or to a casing attachment rigidly connected thereto with a the free-fall brake outer part so that said free-fall brake outer part always rotates along with the drum casing. Due to the arrangement in the interior of the drum casing, the free-fall brake can run in an oil bath or cooling fluid path provided there, which advantageously can also be used to lubricate and/or to cool the transmission when the transmission advantageously at the same time is accommodated in the interior of the drum casing. In this way, a particularly efficient cooling of the free-fall brake can be achieved.

Said transmission, via which the winch drive drives the drum, advantageously can comprise a single-stage or multi-stage planetary transmission which can be accommodated in the interior of the drum. A free-fall brake inner part advantageously can be non-rotatably connected to a planetary transmission element in order to rotate along with said planetary transmission element. Depending on the configuration of the planetary transmission, this can be various planetary transmission elements.

In an advantageous development of the invention, said free-fall brake inner part can be non-rotatably attached to a ring gear of the planetary transmission. In this way, a compact arrangement can be achieved, as the ring gear forms one of the transmission elements of larger diameter and is arranged close to the drum casing so that the free-fall brake easily can engage the drum casing on the one hand and said ring gear on the other hand.

In the case of a two-stage or multi-stage configuration of the planetary transmission, said ring gear can form a ring gear common to a plurality of planetary stages.

The aforementioned inner and outer parts of the free-fall brake in principle might be exchanged with each other, i.e. the free-fall brake inner part might be non-rotatably attached to the drum casing, and the free-fall brake outer part might be non-rotatably attached to the planetary transmission element, for example by corresponding mounting flanges. To achieve a space-saving, small-size arrangement with a direct flux of force, it may be advantageous, however, to attach the free-fall brake outer part to the drum casing in the aforementioned way and to attach the free-fall brake inner part to the ring gear of the planetary transmission.

The free-fall brake advantageously can be actuated, i.e. released and/or applied, via an actuating unit which can be arranged on a side of the drum opposite the winch drive and the holding brake.

Advantageously, said actuating unit is rotatably supported on a bearing counter-shield and/or configured to be rotatable in itself so that at least a part of said actuating unit is freely rotatably with respect to the bearing counter-shield also when the free-fall brake is applied. No torque thereby is transmitted to said bearing counter-shield or is supported thereon.

Advantageously, said actuating unit can include a rotatorily stationary and axially adjustable actuating cylinder for actuating the free-fall brake, which is rotatably supported at least with respect to a part of the free-fall brake. The rotary movement of the free-fall brake thereby is not transmitted to the actuating cylinder so that the same need not rotate as well.

To avoid the introduction of the axial actuating forces of the actuating unit into the bearing counter-shield, the actuating unit can also be axially supported on the drum itself.

Advantageously, said actuating unit at least partly, preferably with a major part, extends within the drum.

Said free-fall brake advantageously can be configured as a multidisk brake, wherein a first disk set can be rotatably attached to the drum and a second disk set can be non-rotatably connected to a transmission element. The interlocking disk sets advantageously can be arranged transversely, in particular perpendicularly to the axis of rotation of the drum and/or can be accommodated in the interior of the drum casing, wherein said first disk set can be non-rotatably attached to the inner wall of the drum casing or to a disk carrier attached thereto. Said second disk set advantageously can be non-rotatably attached to a ring gear of the planetary transmission, for example to an axially protruding cylindrical carrier stub which continues said ring gear.

BRIEF DESCRIPTION OF THE DRAWINGS

The invention will subsequently be explained in detail with reference to an advantageous exemplary embodiment. In the drawing:

FIG. 1: shows a schematic sectional view of a free-fall winch according to an advantageous embodiment of the invention with a non-stationary free-fall brake.

DETAILED DESCRIPTION

As shown in FIG. 1, the free-fall winch 1 comprises a drum 2 which has an approximately cylindrical drum casing 3 onto which a cable 4 can be wound. Said drum casing 3 therefor can include cable grooves on its outside in order to wind up the cable 4 on the drum 2 in a controlled way. Said drum casing 3 laterally and at its ends each is enclosed by a flanged wheel 5 which extends transversely to the longitudinal axis of the drum casing 3 and protrudes beyond its outside dimension.

The drum 2 is rotatably mounted parallel to the longitudinal axis of the cylindrical drum casing 3. For this purpose a pair of bearing shields 6 and 7 can be provided, on which the drum 2 is rotatably mounted. The bearing shields 6 and 7 themselves are mounted on a base structure on which the cable winch is to be used, for example the uppercarriage of a cable excavator.

The cable winch furthermore comprises a winch drive 8, for example in the form of an electric motor or a hydraulic motor, which can be arranged on one side of the drum 2, for example outside the bearing shield 6 provided there, and can be supported on said bearing shield.

The winch drive 8 can rotatorily drive the drum 2 via a transmission 9, wherein said transmission 9 advantageously can comprise a planetary transmission which can be of single-stage or multi-stage configuration.

As shown in FIG. 1, said transmission 9 can be accommodated in the interior of the drum casing 3 so that the winch drive 8 and most of the transmission 9 extend on opposite sides of the bearing shield 6.

For example, the winch drive 8 can drive a sun gear of a planetary stage arranged in the interior of the drum casing 3, whose planet carrier can be coupled with the sun gear of another planetary stage. As is illustrated in FIG. 1, the planetary transmission 2 or 3 also can include more planetary stages in order to achieve the desired gear ratio.

To be able to retain or fix the cable winch under load a holding brake 10 is provided, which can engage the winch drive 8 and/or an element of the transmission 9. Advantageously, the holding brake 10 can be arranged between the winch drive 8 and said transmission 9, in particular coaxially to the output shaft of the winch drive 8 between its motor and the transmission 9. For example, the holding brake 10 can act on the input shaft of the transmission 9, which can be connected to the sun gear of the aforementioned planetary stage.

Said holding brake 10 for example can be a multidisk brake which can be applied by a pretensioning means for example in the form of a spring device and can be released by pressure means. Said holding brake 10 can be arranged outside the bearing shield 6.

As shown in FIG. 1, the free-fall winch 1 furthermore comprises a free-fall brake 11 which couples said transmission 9 with the drum 2 and/or is arranged in the flux of force between winch drive 8 and drum 2.

In particular, said free-fall brake 11 can connect a transmission element of the transmission 9 to the drum 2 so that when the free-fall brake 11 is closed, said transmission element can drive the drum 2, and when the free-fall brake 11 is open, the drum 2 can be rotated at idle in a manner decoupled from the transmission 9.

Advantageously, the free-fall brake 11 can couple a ring gear 12 of the planetary transmission with the drum casing 3 so that—with the free-fall brake 11 open—one part of the free-fall brake 11 rotates along with the drum casing 3 and the other part of the free-fall brake 11 rotates along with the ring gear 12, in case said ring gear 12 rotates. As shown in FIG. 1, said ring gear 12 can include a cylindrical extension 12*a* which can act as a brake carrier and can be rotatably supported on the drum casing 3. A free-fall brake inner part 11*i* can be non-rotatably attached to said ring gear cylinder 12*a*, while a free-fall brake outer part 11*a* can be non-rotatably attached to the casing inner side of the drum casing 3 or to an intermediate part rigidly connected thereto.

As shown in FIG. 1, the free-fall brake 11 advantageously can be configured as a multidisk brake whose two interlocking disk sets are arranged transversely to the axis of rotation of the drum 2. A first disk set can be non-rotatably attached to the inside of the drum casing 3, while a second disk set is non-rotatably coupled with the ring gear 12 or another transmission element.

The free-fall brake 11 can completely be accommodated in the interior of the drum casing 3.

The free-fall brake 11 can be actuated, i.e. released and/or applied, by an actuating device 13 which advantageously likewise can extend in the interior of the drum casing 3 at least for the most part. Said actuating device 13 can comprise a pretensioning device 14 which applies the free-fall brake 11 under pretension. Said pretensioning device 14 for example can comprise a spring device which can axially pretension the disks of the free-fall brake 11.

A pressure-medium device for releasing the pretension can comprise a piston-cylinder unit 15 which on the one hand is coupled with the free-fall brake inner part 11*i* and on the other hand is coupled with the free-fall brake outer part 11*a* in order to tension the two brake parts against each other or release the same from each other, wherein the direction of action of the piston-cylinder unit 15 for example can extend axially, i.e. substantially parallel to the axis of rotation of the drum 2.

Said piston-cylinder unit 15 likewise can at least partly be accommodated in the interior of the drum 2. Independent thereof, the piston-cylinder unit 15 can be rotatably mounted with respect to the drum 2 and/or be axially supported thereon so that braking forces are supported directly on the drum 2. In particular, the bearing counter-shield 7 remains freely rotatable regardless of whether the free-fall brake 11 is applied or released. The bearing counter-shield 7 need not absorb any reaction moments, even if the free-fall brake is slowed down.

In normal hoisting operation, said free-fall brake 11 remains closed so that the winch drive 8 can drive the transmission 9 configured as a planetary transmission, wherein the rotary movement of the ring gear 12 is transferred to the drum 2 via the free-fall brake 11 so that the drum 2 is driven at the rotational speed of the ring gear 12.

Hence, in a normal hoisting or winch operation the free-fall brake 11 rotates at the rotational speed of the drum 2 so that the disks of the free-fall brake 11 circulate in the oil bath which can be provided in the interior of the drum 2 in order to lubricate the transmission 9. To increase the circulating effect, the inner and outer parts of the free-fall brake 11 can be provided with a spline through which the oil or the cooling fluid can flush the free-fall brake more easily.

In free-fall operation, the free-fall brake 11 is released. At the same time, the winch drive 8 and/or the holding brake 10 is slowed down so that the input shaft of the transmission 9 is stationary. Said input shaft of the transmission 9 can be connected to said sun gear 16 so that said sun gear 16 is standing still. The drum 2 can rotate nevertheless, as the ring gear 12, which can form a common ring gear for a plurality of planetary stages, is decoupled from the drum casing 3 by the released free-fall brake 11.

We claim:

1. A free-fall winch comprising a drum rotarily drivable by a winch drive via a transmission and retainable by a holding brake, wherein when the drum is in free-fall operation, the drum is slowable by the holding brake and a free-fall brake, wherein the holding brake is between the winch drive and the free-fall brake, wherein a first end of the free-fall brake is non-rotatably connected to the drum and a second end of the free-fall brake is connected to a transmission element of the transmission so that when the free-fall brake is open and when the free-fall brake is closed, at least part of the free-fall brake is always rotatable with the drum and wherein when the free-fall brake is open, the drum is decoupled from the winch drive and from the holding brake.

2. The free-fall winch according to claim 1, wherein at least a part of the free-fall brake is always rotatable with the drum and/or with the winch drive.

3. The free-fall winch according to claim 1, wherein a bearing counter-shield, on which the drum is rotatably mounted on a side opposite the winch drive and the holding brake, remains torque-free when the free-fall brake is closed.

4. The free-fall winch according to claim 1, wherein the free-fall brake is in a drum casing of the drum, and wherein a free-fall brake outer part is non-rotatably attached to the drum casing.

5. The free-fall winch according to claim 1, wherein the transmission comprises a planetary transmission in the drum, wherein the planetary transmission is a single-stage planetary transmission or a multi-stage planetary transmission, and wherein the free-fall brake is rotatably attached to a planetary transmission element with a free-fall brake inner part.

6. The free-fall winch according to claim 5, wherein the free- fall brake inner part is non-rotatably attached to a ring gear of the planetary transmission.

7. The free-fall winch according to claim 6, wherein the ring gear forms a common ring gear of two or more planetary stages of the multi-stage planetary transmission.

8. The free-fall winch according to claim 1, wherein the free-fall brake is actuatable by an actuator on a side of the drum opposite the winch drive and the holding brake, wherein the actuator is rotatably supported on a bearing counter-shield and/or is rotatable so that at least part of the actuator is freely rotatable with respect to the bearing counter-shield.

9. The free-fall winch according to claim 8, wherein the actuator includes a rotatorily stationary and axially adjustable actuating cylinder for actuating the free-fall brake, which is rotatably mounted with respect to at least part of the free-fall brake and/or with respect to the drum .

10. The free-fall winch according to claim 1, wherein the free-fall brake is configured as a multidisk brake, wherein a first disk set is non-rotatably attached to the drum and a second disk set is non-rotatably attached to a transmission element of the transmission .

11. The free-fall winch according to claim 1, wherein at least part of the free-fall brake comprises oil conveyable and/or oil circulatable contours in the form of flushing grooves, and wherein the at least part of the free-fall brake is continuously rotatable with the drum.

12. The free-fall winch according to claim 1, wherein an output shaft of the winch drive is retainable by the holding brake and/or wherein an input shaft of the transmission is retainable by the holding brake.

* * * * *